US011462353B2

(12) United States Patent
Tanaka

(10) Patent No.: US 11,462,353 B2
(45) Date of Patent: Oct. 4, 2022

(54) WINDING INDUCTOR COMPONENT

(71) Applicant: Murata Manufacturing Co., Ltd., Kyoto-fu (JP)

(72) Inventor: Akira Tanaka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 492 days.

(21) Appl. No.: 16/700,002

(22) Filed: Dec. 2, 2019

(65) Prior Publication Data

US 2020/0194166 A1 Jun. 18, 2020

(30) Foreign Application Priority Data

Dec. 17, 2018 (JP) ..... JP2018-235718

(51) Int. Cl.
*H01F 27/28* (2006.01)
*H01F 27/29* (2006.01)
*H01F 17/04* (2006.01)

(52) U.S. Cl.
CPC ..... *H01F 27/292* (2013.01); *H01F 17/045* (2013.01); *H01F 27/2828* (2013.01)

(58) Field of Classification Search
CPC .... H01F 27/292; H01F 27/2828; H01F 27/29; H01F 17/045
See application file for complete search history.

(56) References Cited

U.S. PATENT DOCUMENTS

2002/0180574 A1* 12/2002 Toi ..... H01F 17/045 336/83
2006/0071749 A1* 4/2006 Aoki ..... H01F 17/045 336/83
2009/0295525 A1* 12/2009 Okawa ..... H01F 27/006 336/192
2014/0292470 A1 10/2014 Yokoyama et al.
2017/0076861 A1* 3/2017 Hasegawa ..... H01F 41/10
2017/0169927 A1* 6/2017 Miyamoto ..... H01F 17/03
2017/0287634 A1* 10/2017 Baba ..... H01F 27/29
2019/0019612 A1* 1/2019 Kawasaki ..... H01F 41/10

FOREIGN PATENT DOCUMENTS

JP H10-312922 A 11/1998
JP 2004-311755 A 11/2004
JP 2014-209590 A 11/2014

OTHER PUBLICATIONS

An Office Action; "Notice of Reasons for Refusal," mailed by the Japanese Patent Office dated Apr. 27, 2021, which corresponds to Japanese Patent Application No. 2018-235718 and is related to U.S. Appl. No. 16/700,002 with English language translation.

* cited by examiner

*Primary Examiner* — Sherman Ng
(74) *Attorney, Agent, or Firm* — Studebaker & Brackett PC

(57) ABSTRACT

A winding inductor component includes a core having a columnar shaft portion and a pair of support portions provided at both ends of the shaft portion. The wiring inductor component further includes terminal electrodes provided on the pair of support portions, respectively, and being non-magnetic bodies, and a wire wound around the shaft portion and having both end portions connected to the terminal electrodes of the pair of support portions.

8 Claims, 5 Drawing Sheets

WINDING INDUCTOR COMPONENT

CROSS-REFERENCE TO RELATED APPLICATION

This application claims benefit of priority to Japanese Patent Application No. 2018-235718, filed Dec. 17, 2018, the entire content of which is incorporated herein by reference.

BACKGROUND

Technical Field

The present disclosure relates to a winding inductor component having a wire wound around a core.

Background Art

In the past, various types of inductor components have been mounted on electronic apparatuses. The winding inductor component has a core and a wire wound around the core. End portions of the wire are connected to terminal electrodes provided on the core. Normally, the end portions of the wire are thermally compression bonded to the terminal electrodes by using a heater tip as described in, for example, Japanese Unexamined Patent Application Publication No. 10-312922, from a viewpoint of manufacturing cost. In order to prevent the terminal electrodes from being molten at the time of the thermal compression bonding, the terminal electrodes include plating layers with nickel electrode layers made of nickel (Ni) or an alloy containing nickel.

SUMMARY

However, since nickel is a magnetic material, when the winding inductor component including the terminal electrodes containing nickel is used in an environment of a strong magnetic field, there is a problem that nickel reacts with the magnetic field to disturb the surrounding magnetic field. For example, when the winding inductor component is used in MRI (magnetic resonance imaging), nickel of the terminal electrodes reacts with a magnetic field to disturb the surrounding magnetic field, resulting in a risk of disturbance of a shot image. As described above, there has been a problem in that nickel contained in the terminal electrodes of the winding inductor component affects the surrounding magnetic field.

Accordingly, the present disclosure provides a winding inductor component which can reduce influences on a surrounding magnetic field.

A winding inductor component according to an embodiment of the present disclosure includes a core having a columnar shaft portion and a pair of support portions provided at both ends of the shaft portion. The winding inductor component further includes terminal electrodes provided on the pair of support portions, respectively, and being non-magnetic bodies, and a wire wound around the shaft portion and having both end portions connected to the terminal electrodes of the pair of support portions.

With the above embodiment, since the terminal electrodes are non-magnetic bodies, it is possible to suppress reaction of the terminal electrodes with a surrounding magnetic field. Therefore, influences on the surrounding magnetic field can be reduced.

Other features, elements, characteristics and advantages of the present disclosure will become more apparent from the following detailed description of the present disclosure (with reference to the attached drawings).

and

Figure 8:
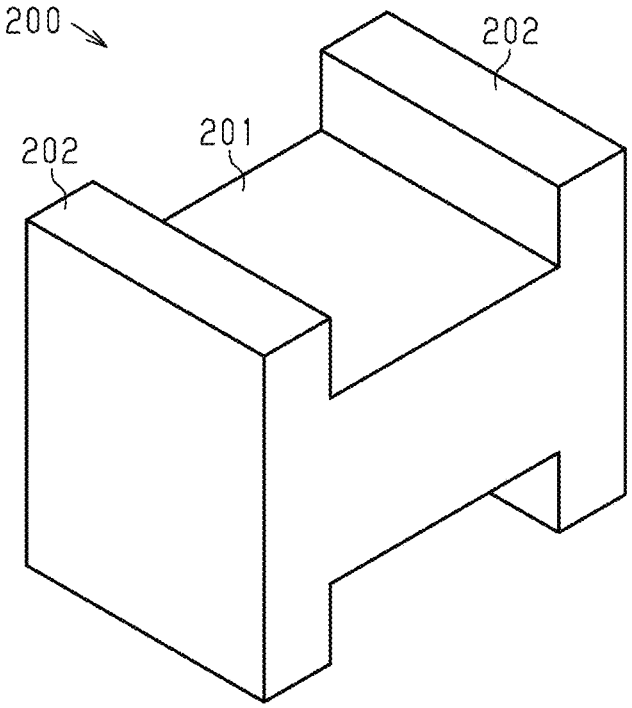

FIG. 8 is a schematic perspective view illustrating a core in another variation.

DETAILED DESCRIPTION

Hereinafter, an embodiment of a winding inductor component will be described. It should be noted that components in the accompanying drawings may be enlarged in order to facilitate understanding. Dimensional ratios of the components may be different from actual ones or different from those in the other figures. Although hatching is applied in the cross-sectional view, hatching of some components may be omitted in order to facilitate understanding.

Figure 1B:
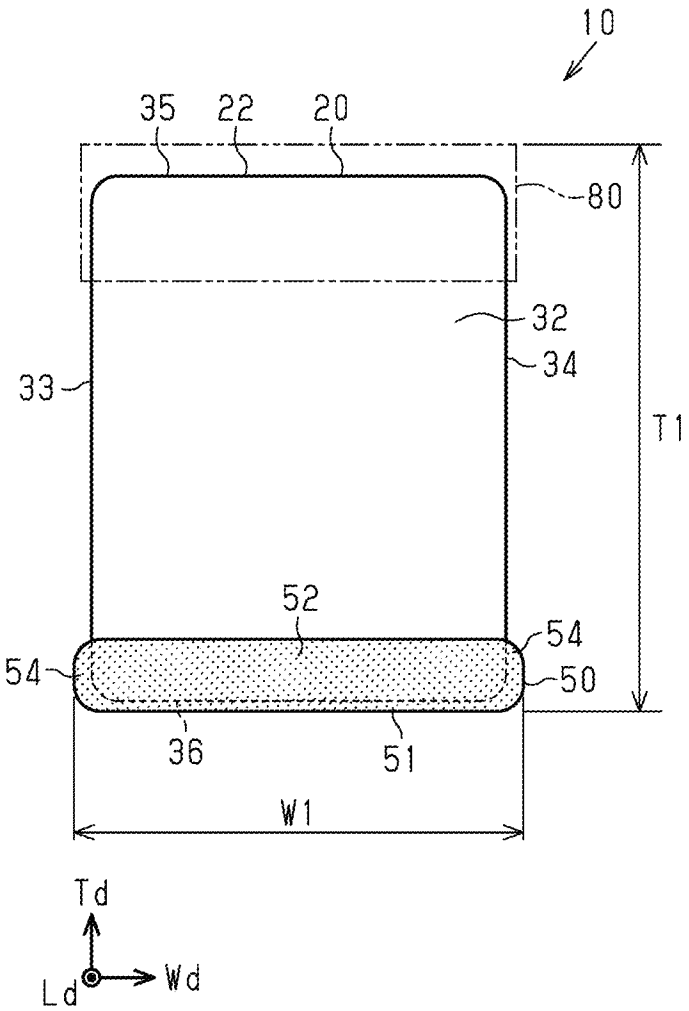
FIG. 1A is a front view of a winding inductor component in one embodiment and FIG. 1B is an end face view of the winding inductor component.
Figure 1A:
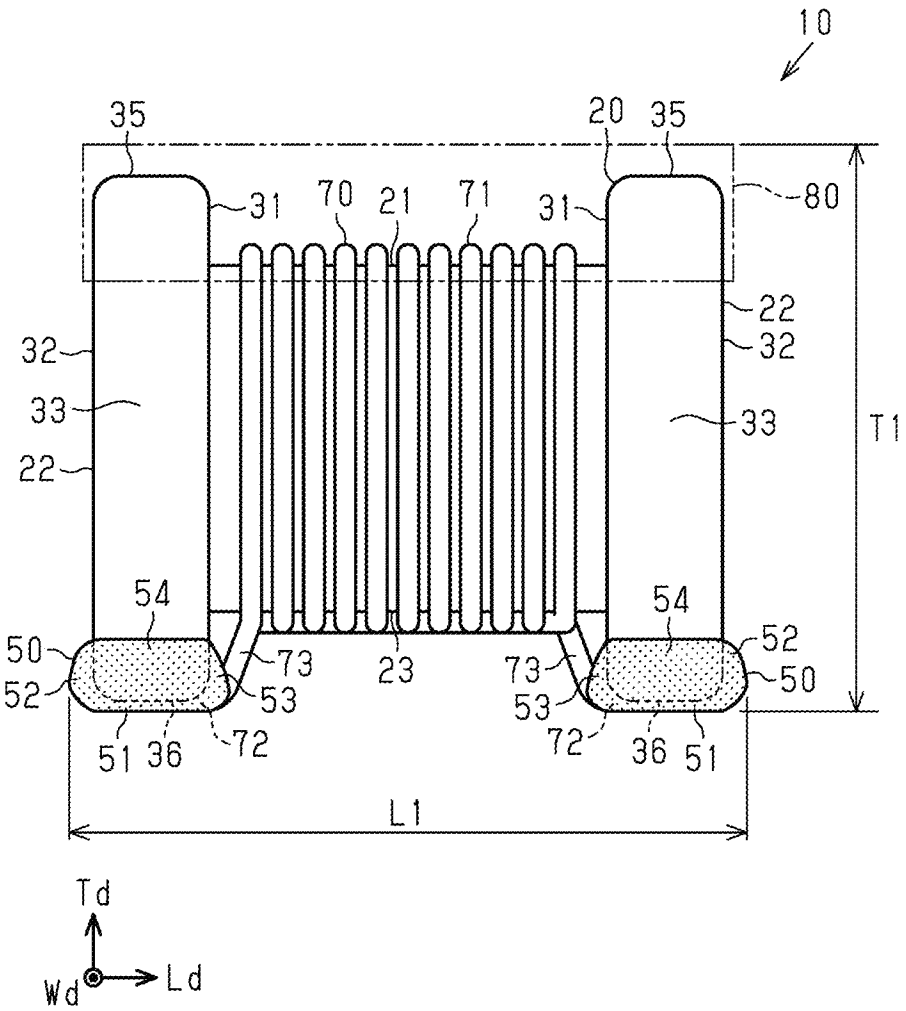
Figure 2:
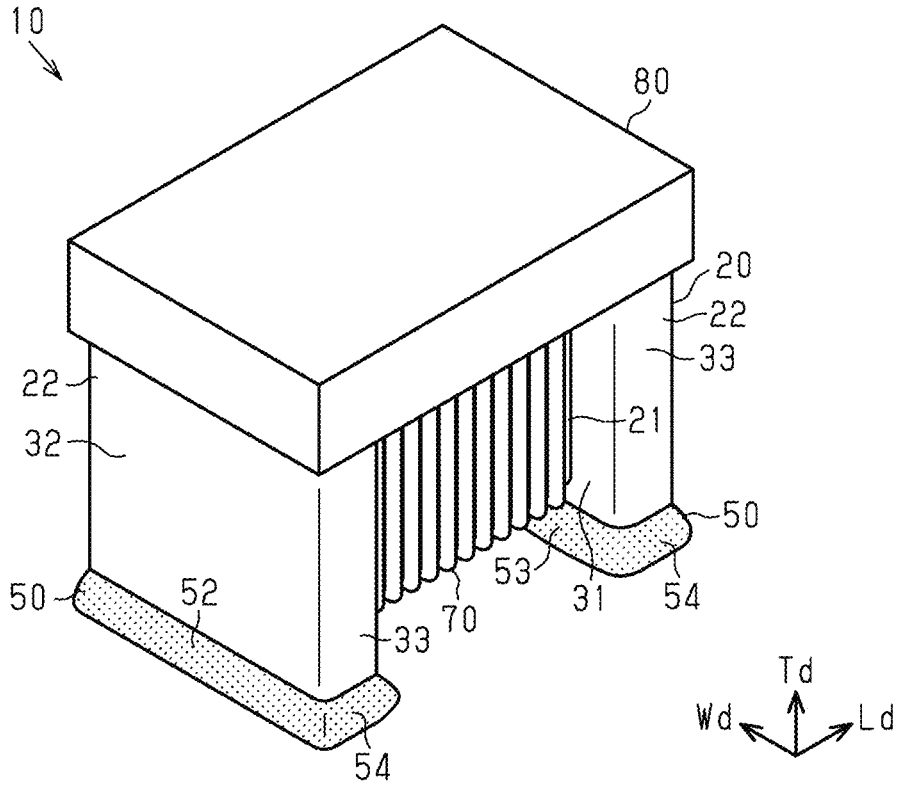
FIG. 2 is a perspective view of the winding inductor component in the embodiment.

A winding inductor component 10 (hereinafter, referred to as inductor component 10) illustrated in FIGS. 1A, 1B and 2 is a surface mount-type winding inductor component that is mounted on a circuit board or the like, for example. The inductor component 10 may be used in a circuit (high-frequency circuit or the like) provided in an inspection apparatus such as MRI (magnetic resonance imaging), for example, and can be used in various apparatuses.

The inductor component 10 includes a core 20 having a columnar shaft portion 21 and a pair of support portions 22 provided at both ends of the shaft portion 21, terminal electrodes 50 provided on the pair of support portions 22, respectively, and being non-magnetic bodies, and a wire 70 wound around the shaft portion 21 and having both end portions connected to the terminal electrodes 50 of the pair of support portions 22.

The shaft portion 21 is formed into a substantially quadrangular columnar shape extending parallel to a lengthwise direction Ld. The pair of support portions 22 is formed into substantially flange shapes having main surfaces of substantially rectangular shapes extending perpendicularly to the lengthwise direction Ld from both ends of the shaft portion 21. The support portions 22 support the shaft portion 21 such that a first direction in which the shaft portion 21 extends is parallel to a mounting object (for example, the circuit board). The pair of support portions 22 is formed integrally with the shaft portion 21. It is preferable that corner portions and ridge line portions of the shaft portion 21 and the pair of support portions 22 be curved or flat by barrel finishing, chamfering, or the like.

As illustrated in FIGS. 1A and 1B, each of the support portions 22 has an inner surface 31 facing the shaft portion 21 side in the lengthwise direction Ld, an end surface 32 facing an outer side portion as an opposite side to the inner surface 31, a pair of side surfaces 33 and 34 on both sides in a width direction Wd, and a top surface 35 and a bottom surface 36 on both sides in a height direction Td. The inner surface 31 of one support portion 22 faces the inner surface 31 of the other support portion 22. The bottom surfaces 36 are surfaces facing the circuit board when the inductor component 10 is mounted on the circuit board, more specifically, are surfaces of both of the support portions on the side where the terminal electrodes are formed. The top surfaces 35 are surfaces on an opposite side to the bottom surfaces 36. The side surfaces 33 and 34 are surfaces that are neither of the inner surfaces 31, the end surfaces 32, the top surfaces 35, nor the bottom surfaces 36.

As described above, in this specification, the direction in which the shaft portion 21 extends is defined as the "lengthwise direction Ld". In addition, the "height direction Td" is defined as a direction orthogonal to the bottom surfaces 36 among directions orthogonal to the "lengthwise direction Ld". Further, the "width direction Wd" is defined as a direction orthogonal to the "lengthwise direction Ld" and the "height direction Td". Note that the "height direction Td" indicates a height from the circuit board on which the inductor component 10 is mounted, and the "lengthwise direction Ld" and the "width direction Wd" indicate a mounting region occupied by the inductor component 10 on the circuit board.

The inductor component 10 of the embodiment has a size of, for example, about 1.6 mm in the lengthwise direction Ld (length dimension L1) and about 0.8 mm in the height direction Td (height dimension T1) and the width direction Wd (width dimension W1). Note that the length dimension L1, the height dimension T1, and the width dimension W1 of the inductor component 10 are not limited to the above-described sizes, respectively. For example, the inductor component 10 may have the length dimension L1 of equal to or greater than about 0.2 mm and equal to or less than about 2.5 mm (i.e., from about 0.2 mm to about 2.5 mm) or the height dimension T1 and the width dimension W1 of equal to or greater than about 0.1 mm and equal to or less than about 2.0 mm (i.e., from about 0.1 mm to about 2.0 mm). For example, the inductor component 10 may have the height dimension T1 and the width dimension W1 which differ from each other.

Figure 3:
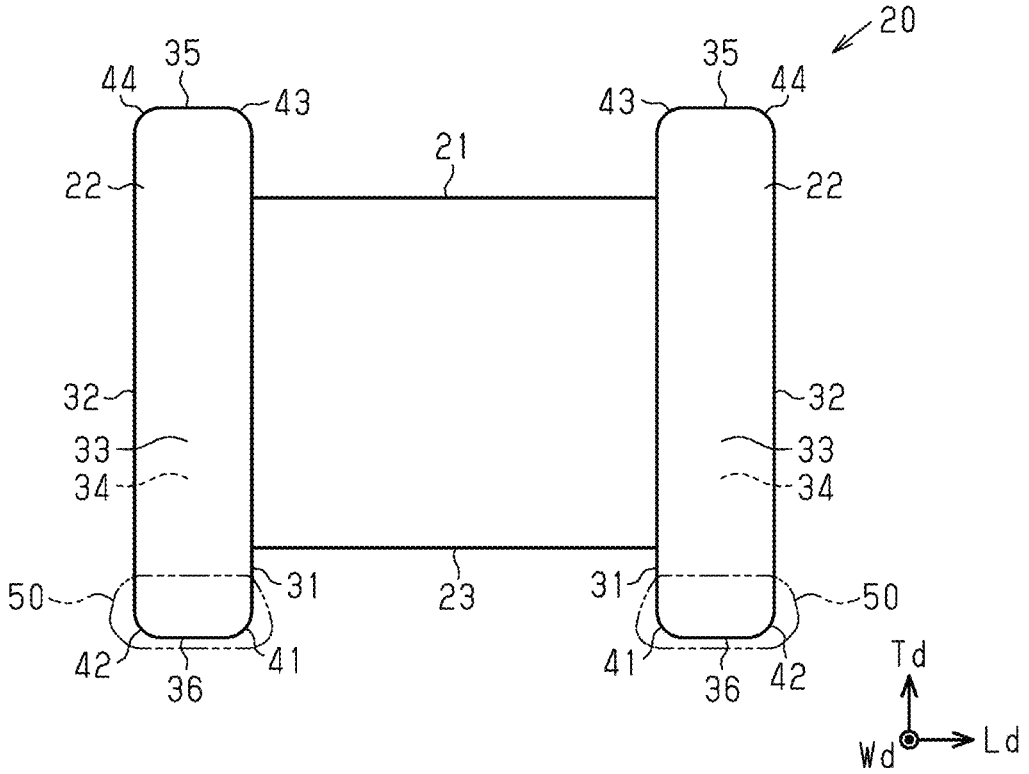
FIG. 3 is a front view of a core in the embodiment.

As illustrated in FIG. 3, the support portions 22 have ridge line portions 41 forming boundaries between the bottom surfaces 36 and the inner surfaces 31, ridge line portions 42 forming boundaries between the bottom surfaces 36 and the end surfaces 32, ridge line portions 43 forming boundaries between the top surfaces 35 and the inner surfaces 31, and ridge line portions 44 forming boundaries between the top surfaces 35 and the end surfaces 32. The surfaces of the ridge line portions 41 to 44 are formed into substantially curved surfaces projecting toward the outer side portion of the core 20 and are substantially cylindrical columnar surfaces (projecting cylindrical columnar surfaces). Although not illustrated in FIG. 3, the support portions 22 also have ridge line portions forming boundaries between the side surfaces 33 and 34 and the inner surfaces 31, the end surfaces 32, the top surfaces 35, and the bottom surfaces 36, respectively, and the ridge line portions are also substantially projecting cylindrical columnar surfaces. The curvature radii of the ridge line portions are equal to one another in the embodiment, but may be different from one another.

As a material of the core 20, a magnetic material (for example, nickel (Ni)-zinc (Zn)-based ferrite, manganese (Mn)-zinc-based ferrite, iron (Fe)-based metal magnetic powder-containing resin), a non-magnetic material (aluminum oxide or glass), or the like can be used. The core 20 may be ceramic (sintered body) or a molded body. The core 20 of the embodiment is made of alumina ceramic using aluminum oxide as a material.

As illustrated in FIGS. 1A, 1B, and 2, the terminal electrodes 50 are formed on the respective support portions 22 on the side of the bottom surfaces 36. The terminal electrodes 50 include bottom surface portion electrodes 51 formed on the bottom surfaces 36 of the support portions 22, end surface portion electrodes 52 formed on the end surfaces 32 of the support portions 22, inner surface portion electrodes 53 formed on the inner surfaces 31 of the support portions 22, and side surface portion electrodes 54 formed on the side surfaces 33 and 34 of the support portions 22.

The bottom surface portion electrodes 51 are formed over the whole bottom surfaces 36 of the support portions 22 and cover the bottom surfaces 36. The end face portion electrodes 52 are formed so as to cover lower portions of the end surfaces 32 of the support portions 22. The inner surface portion electrodes 53 are formed so as to cover lower portions of the inner surfaces 31 of the support portions 22. The side surface portion electrodes 54 are formed so as to cover lower portions of the side surfaces 33 and 34.

The bottom surface portion electrodes 51 and the end surface portion electrodes 52 are formed so as to be continuous with each other with portions on the ridge line portions 42 between the bottom surfaces 36 and the end surfaces 32 interposed therebetween. The bottom surface portion electrodes 51 and the inner surface portion electrodes 53 are formed so as to be continuous with each other with portions on the ridge line portions 41 between the bottom surfaces 36 and the inner surfaces 31 interposed therebetween. The bottom surface portion electrodes 51 and the side surface portion electrodes 54 are formed so as to be continuous with each other with portions on the ridge line portions between the bottom surfaces 36 and the side surfaces 33 and 34 interposed therebetween. The end surface portion electrodes 52 and the side surface portion electrodes 54 are formed so as to be continuous with each other with portions on the ridge line portions between the end surfaces 32 and the side surfaces 33 and 34 interposed therebetween. The inner surface portion electrodes 53 and the side surface portion electrodes 54 are formed so as to be continuous with each other with portions on the ridge line portions between the inner surfaces 31 and the side surfaces 33 and 34. The adjacent electrodes are continuously formed in each of the terminal electrodes 50 in this manner, and the bottom surface portion electrodes 51, the end surface portion electrodes 52, the inner surface portion electrodes 53, and the side surface portion electrodes 54 are integrally formed. Note that the bottom surface portion electrodes 51, the end surface portion electrodes 52, the inner surface portion electrodes 53, and the side surface portion electrodes 54 do not include the portions of the terminal electrodes 50, which cover the above-mentioned ridge line portions. That is, the bottom surface portion electrodes 51 are portions just above the bottom surfaces 36.

In the embodiment, the end surface portion electrodes 52, the inner surface portion electrodes 53, and the side surface portion electrodes 54 are formed to have heights equal to one another. As for each of the electrodes of the end surface portion electrodes 52, the inner surface portion electrodes 53, and the side surface portion electrodes 54, the height of the electrode is a length from a surface (lower end) of the bottom surface portion electrode 51 to an upper end of the electrode measured along the height direction Td. The upper ends of the end surface portion electrodes 52, the inner surface portion electrodes 53, and the side surface portion electrodes 54 are positioned closer to the bottom surfaces 36 side of the support portions 22 than the bottom surface 23 of the shaft portion 21.

Figure 4:
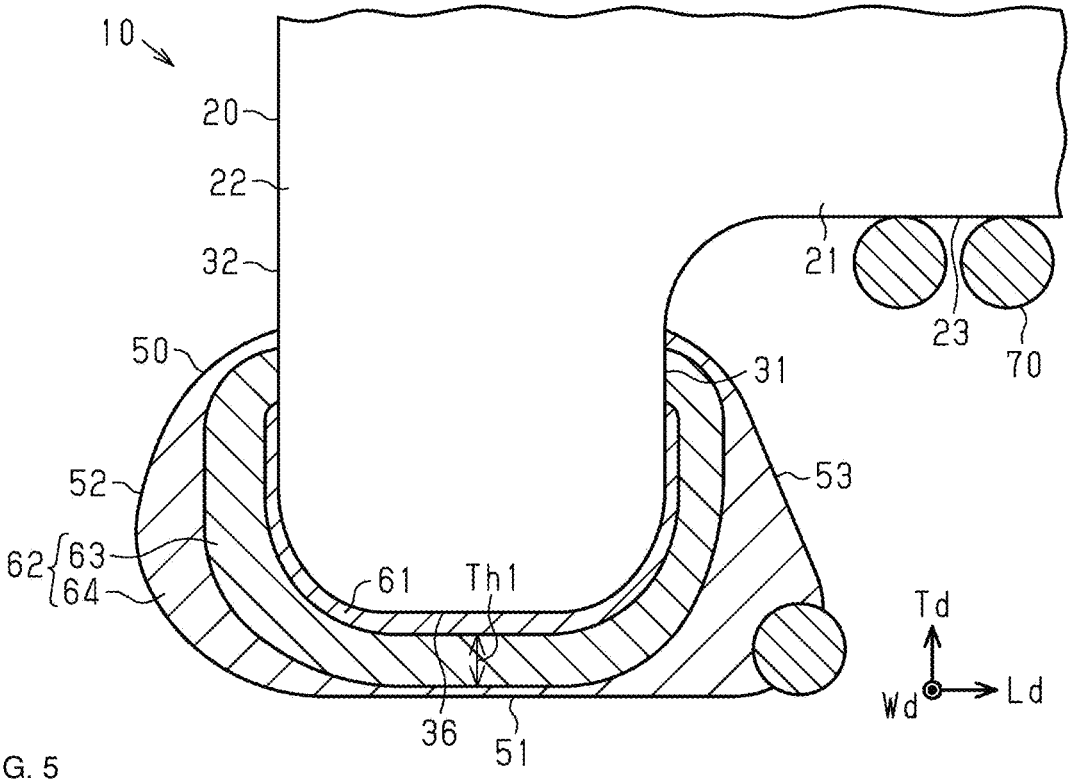
FIG. 4 is an enlarged cross-sectional view of the winding inductor component in the embodiment.
Figure 5:
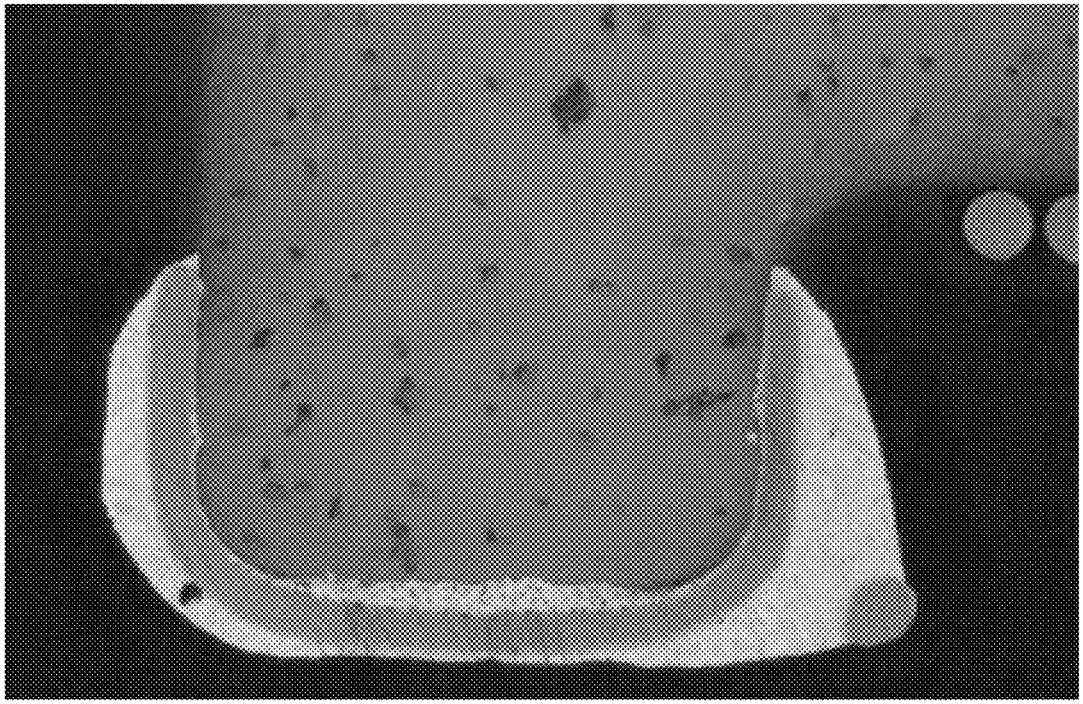
FIG. 5 is a cross-sectional photograph of the winding inductor component in the embodiment.

As illustrated in FIGS. 4 and 5, the terminal electrodes 50 include base layers 61 formed on the surfaces of the support portions 22 and plating layers 62 covering the base layers 61. Each of the base layers 61 and the plating layers 62 is made of a non-magnetic material. That is, the terminal electrodes 50 are non-magnetic bodies.

The base layers 61 are layers of sintered bodies of glass containing silver (Ag). In the embodiment, a conductive material of the base layers 61 is silver, but is not limited to silver. It is also possible to use a metal material which is a non-magnetic good conductor such as a silver palladium alloy (Ag—Pd) therefor. The base layers 61 are formed by coating and baking conductive pastes that is resin containing silver powder and glass powder, for example.

The plating layers 62 are composed of first plating layers 63 covering the base layers 61 and second plating layers 64 covering the first plating layers 63. The first plating layers 63 are metal layers which are made of copper (Cu) and are adjacent to the base layers 61. The second plating layers 64 are metal layers which are made of tin (Sn) and are adjacent to the first plating layers 63. As a material of the second plating layers 64, a non-magnetic metal material having a pro-solder property, such as gold (Au), palladium, and gold palladium alloy (Au—Pd) can be used instead of tin. The first plating layers 63 and the second plating layers 64 are formed by, for example, an electrolytic plating method. Note that the first plating layers 63 in the embodiment correspond to copper electrode layers, and the second plating layers 64 in the embodiment correspond to tin electrode layers.

A thickness dimension Th1 of the first plating layers 63 is preferably equal to or more than about 10 μm and equal to or less than about 30 μm (i.e., from about 10 μm to about 30 μm). Further, the thickness dimension Th1 of the first plating layers 63 is more preferably equal to or more than about 15 μm and equal to or less than about 20 μm (i.e., from about 15 μm to about 20 μm). For example, in the embodiment, the thickness dimension Th1 of the first plating layers 63 is about 17 μm. The thickness dimension Th1 of the first plating layers 63 is a thickness based on the surfaces of the base layers 61 which are formation surfaces thereof. However, since end portions of the first plating layers 63 may extend over the base layers 61 or become extremely thin, they are not measurement targets of the thickness dimension Th1.

In the bottom surface portion electrodes 51, the first plating layers 63 are thicker than the second plating layers 64. In the bottom surface portion electrodes 51, the base layers 61 are thinner than the first plating layers 63.

As illustrated in FIG. 1A, the wire 70 wound around the shaft portion 21 includes a core wire having a substantially circular cross section and a coating member coating the surface of the core wire, for example. As a material of the core wire, for example, a material containing a metal material having good conductivity, such as copper, silver, or an alloy thereof, as a main component can be used. As a material of the coating member, for example, an insulating resin material such as polyurethane, polyester, or polyamide imide can be used. Both end portions of the wire 70 are respectively connected to the pair of terminal electrodes 50, and specifically, the core wire of the wire 70 is electrically connected to the terminal electrodes 50 by being in contact with or integrated with them.

The wire 70 has a winding portion 71 wound around the shaft portion 21, connection portions 72 connected to the terminal electrodes 50, and crossover portions 73 bridged between the connection portions 72 and the winding portion 71. The connection portions 72 are connected to the bottom surface portion electrodes 51 of the terminal electrodes 50, which are formed on the bottom surfaces 36 of the support portions 22. A winding mode of the winding portion 71 around the shaft portion 21 may be any one of well-known winding modes such as single-layer winding, multilayer winding, close contact winding, and pitch winding. For example, in the embodiment, the winding portion 71 is wound around the shaft portion 21 such that an adjacent turn for a single layer makes close contact with the shaft portion 21. The winding axis of the winding portion 71 is parallel to the lengthwise direction Ld.

As illustrated in FIGS. 1A, 4, and 5, the end portions of the wire 70 and the terminal electrodes 50 are connected to each other by thermal compression bonding using a heater chip, for example. The end portions of the wire 70 and the terminal electrodes 50 can be connected by placing the end portions of the wire 70 (portions to be the connection portions 72) on the bottom surface portion electrodes 51, and then, heating and pressurizing them with the heater chip. Specifically, the end portions of the wire 70 are pressed against the bottom surface portion electrodes 51 with the heater tip heated to a temperature in a range of about 300 to 500° C., preferably about 500° C. At the end portions (connection portions 72) of the wire 70, the coating member is thereby peeled off, and the exposed core wire is connected to the second plating layers 64 in the bottom surface portion electrodes 51. In the embodiment, the second plating layers 64 are made of tin and are therefore molten by heating with the heater chip, and the end portions of the wire 70 are pushed into the second plating layers 64 by heating with the heater chip and are connected to the terminal electrodes 50. A connection method is not limited to this, and various well-known methods can be used.

It is preferable that the second plating layers 64 be thicker than the first plating layers 63 in the end surface portion electrodes 52, the inner surface portion electrodes 53, and the side surface portion electrodes 54. In this case, wettability of the end surface portion electrodes 52, the inner surface portion electrodes 53, and the side surface portion electrodes 54 is improved. When the inductor component 10 is mounted on the circuit board, mounting solders form higher fillets and fixing force of the inductor component 10 onto the circuit board can be further improved.

As illustrated in FIG. 2, the inductor component 10 further includes a cover member 80. In FIGS. 1A and 1B, the cover member 80 is indicated by an alternate long and two short dashes line in order to make the core 20 and the wire 70 easy to recognize.

The cover member 80 is disposed between the pair of support portions 22 and covers the wire 70 on the side of the top surfaces 35. Specifically, the cover member 80 is formed from the top surface 35 of one support portion 22 to the top surface 35 of the other support portion 22 with a portion above the shaft portion 21 interposed therebetween. As a material of the cover member 80, for example, a resin material such as epoxy resin can be used.

For example, when the inductor component 10 is mounted on the circuit board, the cover member 80 can be made to be reliably sucked by a suction nozzle. Moreover, the cover member 80 prevents damage to the wire 70 when the wire 70 is being sucked by the suction nozzle. It is possible to improve an inductance value (L value) of the inductor component 10 by using a magnetic material such as metal magnetic powder-containing resin for the cover member 80. On the other hand, it is possible to reduce magnetic loss and improve a Q value of the inductor component 10 by using a non-magnetic material such as resin containing no magnetic powder for the cover member 80. In this case, resin containing a filler such as silicon oxide or barium sulfate may be used for the cover member 80.

Actions of the embodiment will be described.

Since the terminal electrodes 50 of the inductor component 10 of the embodiment are non-magnetic bodies, reaction of the terminal electrodes 50 with a surrounding magnetic field is suppressed. Therefore, even if the inductor component 10 including the terminal electrodes 50 is used in an environment of a strong magnetic field, it is possible to suppress disturbance in the surrounding magnetic field caused by the terminal electrodes 50. For example, when the inductor component 10 is used in MRI, it becomes possible to suppress disturbance in a shot image caused by the terminal electrodes 50.

Further, since the terminal electrodes 50 are non-magnetic bodies, disturbance in a magnetic field generated by the inductor component 10 caused by the terminal electrodes 50 is suppressed. For example, when nickel is contained in the terminal electrodes as in the technique in the past, since nickel is a magnetic material, a magnetic flux generated upon supply of electric current to a wire winding portion is interrupted to cause eddy current loss or the like, resulting in a problem of decrease in the Q value. However, in the inductor component 10 of the embodiment, since the terminal electrodes 50 are non-magnetic bodies, a magnetic field of a coil formed by the wire 70 is not interrupted by the terminal electrodes 50, so that it is possible to suppress decrease in the Q value.

It is preferable that the support portions 22 be made of ceramic, the terminal electrodes 50 include the base layers 61 being the sintered bodies of glass containing silver, which are formed on the surfaces of the support portions 22, and the plating layers 62 which cover the base layers 61, and the plating layers 62 include the first plating layers 63 as the copper electrode layers, which are made of copper and cover the base layers 61. In this case, since both of the support portions 22 and the base layers 61 are the sintered bodies, close contact performance between the support portions 22 and the terminal electrodes 50 can be improved. Further, when the terminal electrodes 50 are heated in connection of the end portions of the wire 70 to the terminal electrodes 50 or in or after mounting of the inductor component 10, the first plating layers 63 of the plating layers 62, which cover the base layers 61, can suppress melting and flow-out of the base layers 61. Accordingly, it is possible to improve heat resistance of the inductor component 10.

In addition, it is preferable that the thickness dimension Th1 of the first plating layers 63 as the copper electrode layers be equal to or greater than about 10 μm. With this thickness dimension Th1, even when the end portions of the wire 70 and the terminal electrodes 50 are thermally compression bonded to each other, the first plating layers 63 can suppress melting and flow-out of the base layers 61 more reliably. Accordingly, it is possible to further improve the heat resistance of the inductor component 10. Further, when the inductor component 10 is reflow-mounted, the first plating layers 63 can suppress melting and flow-out of the base layers 61 caused by heat at the time of performing reflow mounting.

Moreover, it is preferable that the thickness dimension Th1 of the first plating layers 63 as the copper electrode layers be equal to or less than about 30 μm. With this thickness dimension Th1, excessive increase of the inductor component 10 in height due to the terminal electrodes 50 and deterioration in coplanarity due to variations in the height of the terminal electrodes 50 between the pair of support portions 22 can be suppressed.

Further, it is preferable that the terminal electrodes 50 have the bottom surface portion electrodes 51 formed on the bottom surfaces 36 of the support portions 22, the plating layers 62 include the second plating layers 64 as the tin electrode layers, which are made of tin and cover the copper electrode layers (first plating layers 63), the first plating layers 63 be thicker than the second plating layers 64 in the bottom surface portion electrodes 51, and the end portions of the wire 70 be connected to the bottom surface portion electrodes 51. Since copper and tin form an alloy, when the second plating layers 64 made of tin are thicker than the first plating layers 63 made of copper, there is the following risk. That is, when the terminal electrodes 50 are heated, copper forming the first plating layers 63 are diffused into the second plating layers 64 made of tin and the first plating layers 63 become extremely thin or eliminated. Then, the base layers 61 flow out, and the terminal electrodes 50 are easily separated from the support portions 22 of the core 20. However, when the first plating layers 63 are thicker than the second plating layers 64 in the bottom surface portion electrodes 51 to which the end portions of the wire 70 are connected, even if the end portions of the wire 70 and the terminal electrodes 50 are heated for thermal pressure bonding, the first plating layers 63 are suppressed from becoming excessively thin or eliminated. Therefore, it is possible to further suppress melting and flow-out of the base layers 61.

It is preferable that the base layers 61 be thinner than the first plating layers 63 in the bottom surface portion electrodes 51. Therefore, excessive increase in the thickness of the terminal electrodes 50 in the direction orthogonal to the bottom surfaces 36 (that is in the height direction Td) can be suppressed, and excessive increase of the inductor component 10 in height due to the terminal electrodes 50 and deterioration in the coplanarity due to the variations in the height of the terminal electrodes 50 between the pair of support portions 22 can be suppressed.

Effects of the embodiment will be described.

(1) The inductor component 10 includes the core 20 having the columnar shaft portion 21 and the pair of support portions 22 provided at both ends of the shaft portion 21, the terminal electrodes 50 provided on the pair of support portions 22, respectively, and being non-magnetic bodies, and the wire 70 wound around the shaft portion 21 and having both end portions connected to the terminal electrodes 50 of the pair of support portions 22.

Since the terminal electrodes 50 are non-magnetic bodies, it is possible to suppress reaction of the terminal electrodes 50 with the surrounding magnetic field. Therefore, influences on the surrounding magnetic field can be reduced. Further, since the terminal electrodes 50 are the non-magnetic bodies, disturbance of the magnetic field generated by the inductor component 10 due to the terminal electrodes 50 can be suppressed. As a result, it is possible to suppress decrease in the Q value.

(2) It is preferable that the support portions 22 be made of ceramic, and the terminal electrodes 50 include the base layers 61 being the sintered bodies of glass containing silver, which are formed on the surfaces of the support portions 22, and the plating layers 62 which cover the base layers 61. In this case, since both of the support portions 22 and the base layers 61 are the sintered bodies, close contact performance between the support portions 22 and the terminal electrodes 50 can be improved.

(3) It is preferable that the plating layers 62 include the first plating layers 63 as the copper electrode layers, which are made of copper and cover the base layers 61. In this case, when the terminal electrodes 50 are heated during connection of the end portions of the wire 70 to the terminal electrodes 50 or in or after mounting of the inductor component 10, the first plating layers 63 of the plating layers 62, which cover the base layers 61, can suppress melting and flow-out of the base layers 61. As a result, it is possible to suppress separation of the terminal electrodes 50 from the support portions 22 of the core 20. Accordingly, it is possible to improve the heat resistance of the inductor component 10.

(4) It is preferable that the thickness dimension Th1 of the first plating layers 63 as the copper electrode layers be equal to or greater than about 10 μm and equal to or less than about 30 μm (i.e., from about 10 μm to about 30 μm). With this thickness dimension Th1, even when the end portions of the wire 70 and the terminal electrodes 50 are thermally compression bonded to each other, the first plating layers 63 can suppress melting and flow-out of the base layers 61 more reliably. As a result, it is possible to further suppress the separation of the terminal electrodes 50 from the support portions 22 of the core 20. Accordingly, it is possible to further improve the heat resistance of the inductor component 10.

When the thickness dimension Th1 of the first plating layers 63 as the copper electrode layers is equal to or less than about 30 μm, excessive increase of the inductor component 10 in height due to the terminal electrodes 50 and deterioration in the coplanarity due to variations in the height of the terminal electrodes 50 between the pair of support portions 22 can be suppressed.

(5) It is preferable that the terminal electrodes 50 have the bottom surface portion electrodes 51 formed on the bottom surfaces 36 of the support portions 22, the plating layers 62 include the second plating layers 64 as the tin electrode layers, which are made of tin and cover the copper electrode layers (first plating layers 63), the first plating layers 63 be thicker than the second plating layers 64 in the bottom surface portion electrodes 51, and the end portions of the wire 70 be connected to the bottom surface portion electrodes 51.

Since copper and tin form an alloy, when the second plating layers 64 made of tin are thicker than the first plating layers 63 made of copper, there is the following risk. That is, when the terminal electrodes 50 are heated, copper forming the first plating layers 63 are diffused into the second plating layers 64 made of tin and the first plating layers 63 are made extremely thin or eliminated. Then, the base layers 61 flow out, and the terminal electrodes 50 are easily separated from the support portions 22 of the core 20. However, when the first plating layers 63 are thicker than the second plating layers 64 in the bottom surface portion electrodes 51 to which the end portions of the wire 70 are connected, even if the end portions of the wire 70 and the terminal electrodes 50 are heated for thermal pressure bonding, the first plating layers 63 are suppressed from becoming excessively thin or eliminated. Therefore, it is possible to further suppress melting and flow-out of the base layers 61. As a result, it is possible to further suppress the separation of the terminal electrodes 50 from the support portions 22 of the core 20. Accordingly, it is possible to further improve the heat resistance of the inductor component 10.

(6) It is preferable that the terminal electrodes 50 have the bottom surface portion electrodes 51 formed on the bottom surfaces 36 of the support portions 22, and the base layers 61 be thinner than the first plating layers 63 in the bottom surface portion electrodes 51. Therefore, excessive increase in the thickness of the terminal electrodes 50 in the direction orthogonal to the bottom surfaces 36 can be suppressed, and excessive increase of the inductor component 10 in height due to the terminal electrodes 50 and deterioration in the coplanarity due to the variations in the height of the terminal electrodes 50 between the pair of support portions 22 can be suppressed.

Variations

The embodiment can be varied and implemented as follows. The embodiment and the following variations can be implemented in combination with each other within a technically incompatible range.

For the above embodiment, the shape of the terminal electrodes 50 may be changed as appropriate.

Figure 6:
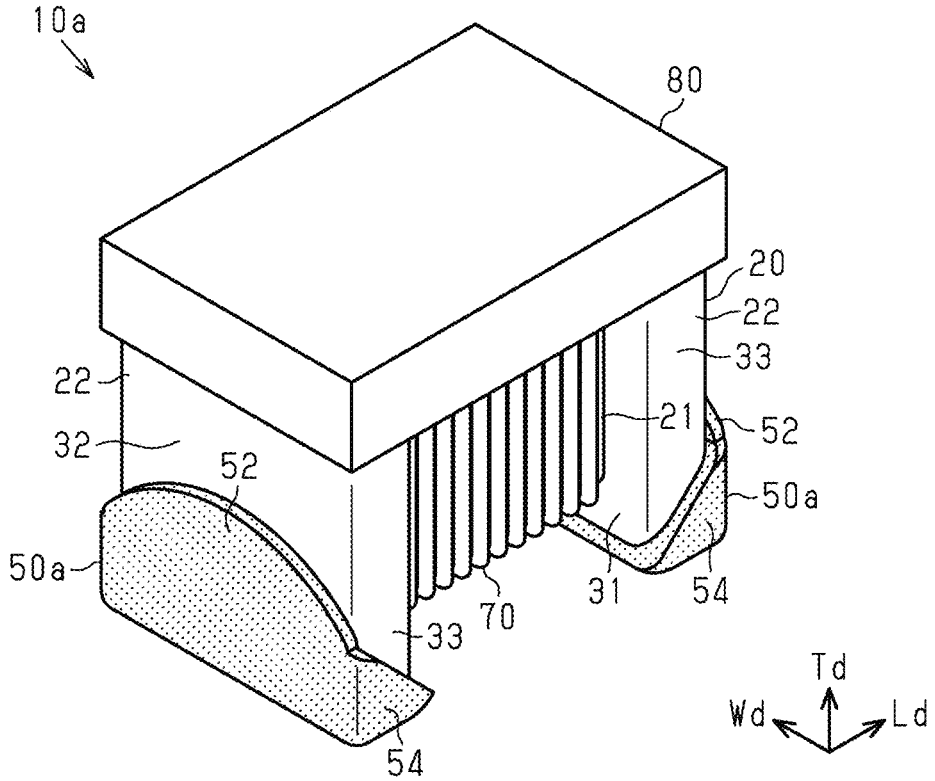
FIG. 6 is a perspective view illustrating a winding inductor component in a variation.
Figure 7:
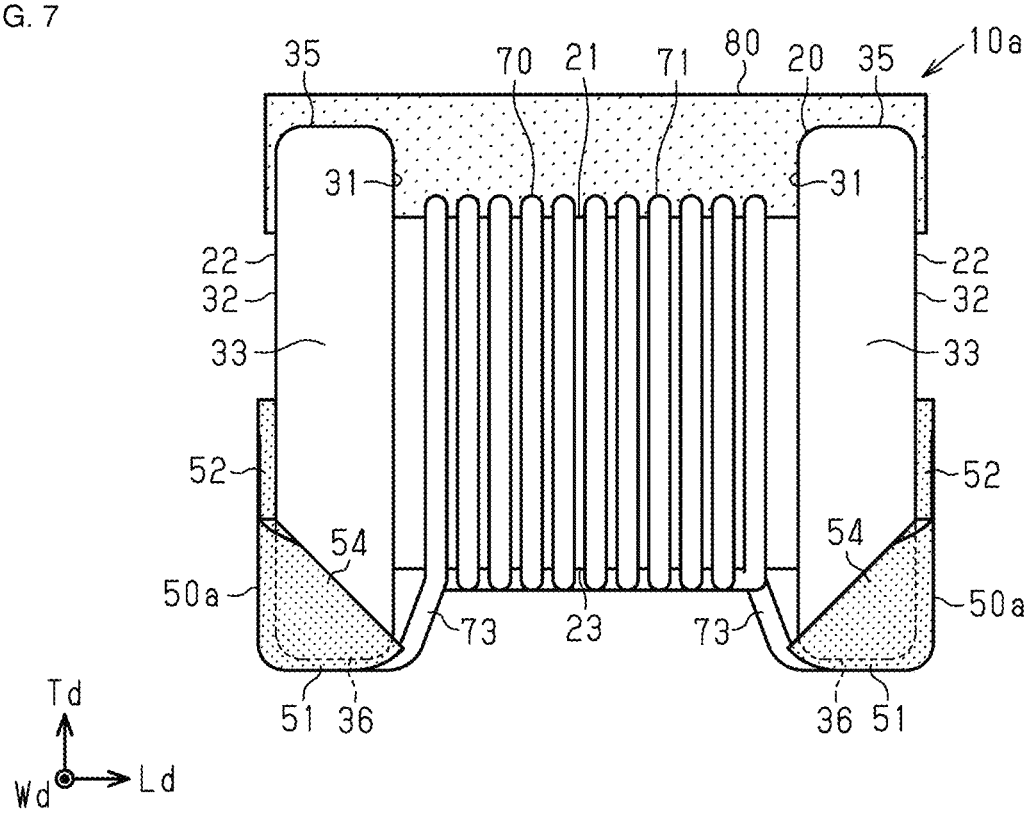
FIG. 7 is a front view illustrating the winding inductor component in the variation.

For example, terminal electrodes 50*a* provided in a winding inductor component 10*a* illustrated in FIGS. 6 and 7 are increased in height from end portions on the sides of the inner surfaces 31 of the pair of support portions 22, which face each other, toward end portions on the sides of the end surfaces 32 of the support portions 22, which are opposite sides to the inner surfaces 31. In the example illustrated in FIGS. 6 and 7, the same reference numerals denote components corresponding to those in the above embodiment. The terminal electrodes 50*a* are non-magnetic bodies similarly to the terminal electrodes 50 in the above embodiment. When seen from the width direction Wd (as in a state illustrated in FIG. 7), the terminal electrodes 50*a* are gradually increased in height from the end portions on the sides of the inner surfaces 31 of the support portions 22 to the end portions of the side surface portion electrodes 54 on the sides of the end surfaces 32 and are the highest in the end surface portion electrodes 52.

In this case, the terminal electrodes 50*a* are increased in surface area by increasing the height of portions covering the end surfaces 32 of the support portions 22. This increase in the surface area enables the mounting solders to form higher fillets along the end surface portion electrodes 52 during mounting of the winding inductor component 10*a* on the circuit board, so that fixing force of the winding inductor component 10*a* onto the circuit board is further improved. In particular, even if the winding inductor component 10*a* is miniaturized, it is easy to secure the fixing force. On the other hand, since increase in the height of the inner surface portion electrodes 53 can be suppressed relative to the height of the end surface portion electrodes 52, even if the mounting solders are diffused upward along the inner surface portion electrodes 53 in mounting of the winding inductor component 10*a* on the circuit board, adhesion of the mounting solders to the winding portion 71 can be suppressed. When the height of the portions covering the end surfaces 32 of the support portions 22 is increased, the terminal electrodes 50 interrupt a magnetic flux of a high density, which is generated along the shaft portion 21, upon supply of electric current to the coil portion 71. The terminal electrodes 50*a* are however the non-magnetic bodies, and it is therefore possible to suppress decrease in the Q value due to interruption of the magnetic flux.

As long as the terminal electrodes 50*a* illustrated in FIGS. 6 and 7 are formed such that the end portions on the sides of the end surfaces 32 are the highest, portions which are partially lowered from the end portions on the sides of the inner surfaces 31 toward the end portions on the sides of the end surfaces 32 may be present.

In the terminal electrodes 50 of the above embodiment, the height of the end surface portion electrodes 52, the height of the inner surface portion electrodes 53, and the height of the side surface portion electrodes 54 may be different from one another. Alternatively, terminal electrodes without including at least one electrodes of the inner surface portion electrodes 53 and the side surface portion electrodes 54 may be used. The shapes of the terminal electrodes 50 formed on the pair of support portions 22 are the same in the above embodiment, but may be different from each other.

In the above embodiment, in the bottom surface portion electrodes 51, the base layers 61 are thinner than the first plating layers 63. However, in the bottom surface portion electrodes 51, the thickness of the base layers 61 may be equal to or greater than the thickness of the first plating layers 63.

The thickness of the first plating layers 63 and the thickness of the second plating layers 64 in the bottom surface portion electrodes 51 are not limited to those in the above embodiment and may be changed as appropriate.

In the above embodiment, the plating layers 62 are composed of the first plating layers 63 and the second plating layers 64. However, it is sufficient that the plating layers 62 are composed of equal to or more than one metal layers made of a non-magnetic metal material.

In the above embodiment, the terminal electrodes 50 are composed of the base layers 61 and the plating layers 62. However, as long as the terminal electrodes 50 are made of a non-magnetic material, the structure thereof is not limited to that in the above embodiment and may be changed as appropriate.

The shape of the cover member 80 may be changed as appropriate from that in the above embodiment. For example, the cover member 80 may not cover the top surfaces 35 of the support portions 22, but may be disposed only between the pair of support portions 22. The cover member 80 is formed so as to cover the wire 70 (winding portion 71) wound around the shaft portion 21, and the top surface of the cover member 80 is flush with the top surfaces 35 of the support portions 22.

Although the cover member 80 is formed so as to cover only the wire 70 in the portion above the shaft portion 21 between the support portions 22 in the above embodiment, it may be configured differently. For example, the cover member 80 may have such shape that it covers the wire 70 on both side surfaces of the shaft portion 21 in addition to the portion above the shaft portion 21. For example, the cover member 80 may have such shape that it covers the whole winding portion 71 including the wire 70 on the bottom surface of the shaft portion 21. Further, the inductor component 10 does not necessarily include the cover member 80.

The shape of the core 20 may be changed as appropriate from that in the above embodiment.

A core 200 illustrated in FIG. 8 includes a shaft portion 201 having a substantially rectangular parallelepiped shape and support portions 202 at both end portions of the shaft portion 201. The support portions 202 are formed to have the same width as that of the shaft portion 201 and are formed to protrude upward and downward relative to the shaft portion 201. That is, the core 200 is formed so as to have a substantially H-shaped side surface. It is noted that the core 200 illustrated in FIG. 8 is a schematic example, and the shapes of the shaft portion 201 and the support portions 202 can be changed as appropriate.

Specifically, the shaft portion of the core may have a substantially cylindrical columnar shape or a substantially polygonal columnar shape other than the substantially quadrangular columnar shape. The substantially columnar shape also includes a substantially frustum shape. The support portions of the core may have main surfaces of another substantially polygonal shape such as a substantially square shape or a substantially circular or elliptical flange shape. Note that the substantially flange shape includes all of shapes which respectively differ in that the thickness is thicker than, thinner than, or equivalent to the thickness of each side of the main surfaces. Further, the shaft portion and the support portions may not be formed integrally, and those formed as separate members may be bonded to each other with an adhesive or the like.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A winding inductor component comprising:

a core having a columnar shaft portion and a pair of support portions provided at both ends of the shaft portion;

terminal electrodes provided on the pair of support portions, respectively, and being non-magnetic bodies; and a wire wound around the shaft portion and having both end portions connected to the terminal electrodes of the pair of support portions, wherein the support portions are made of ceramic, the terminal electrodes include base layers being sintered bodies of glass containing silver, which are formed on surfaces of the support portions, and plating layers which cover the base layers, the plating layers include copper electrode layers made of copper and covering the base layer, the terminal electrodes have bottom surface portion electrodes formed on bottom surfaces of the support portions, the plating layers include tin electrode layers made of tin and covering the copper electrode layers, the copper electrode layers are thicker than the tin electrode layers in the bottom surface portion electrodes, and end portions of the wire are connected to the bottom surface portion electrodes.

2. The winding inductor component according to claim 1, wherein a thickness dimension of the copper electrode layers is from about 10 μm to about 30 μm.

3. The winding inductor component according to claim 1, wherein the terminal electrodes are increased in height from end portions on sides of inner surfaces of the pair of support portions, which face each other, toward end portions on sides of end surfaces of the support portions, which are opposite sides to the inner surfaces.

4. The winding inductor component according to claim 2, wherein the terminal electrodes have bottom surface portion electrodes formed on bottom surfaces of the support portions, and the base layers are thinner than the copper electrode layers in the bottom surface portion electrodes.

5. The winding inductor component according to claim 2, wherein the terminal electrodes are increased in height from end portions on sides of inner surfaces of the pair of support portions, which face each other, toward end portions on sides of end surfaces of the support portions, which are opposite sides to the inner surfaces.

6. A winding inductor component comprising:

a core having a columnar shaft portion and a pair of support portions provided at both ends of the shaft portion;

terminal electrodes provided on the pair of support portions, respectively, and being non-magnetic bodies; and a wire wound around the shaft portion and having both end portions connected to the terminal electrodes of the pair of support portions, wherein the support portions are made of ceramic, the terminal electrodes include base layers being sintered bodies of glass containing silver, which are formed on surfaces of the support portions, and plating layers which cover the base layers, the plating layers include copper electrode layers made of copper and covering the base layers, the terminal electrodes have bottom surface portion electrodes formed on bottom surfaces of the support portions, and the base layers are thinner than the copper electrode layers in the bottom surface portion electrodes.

7. The winding inductor component according to claim 4, wherein the terminal electrodes are increased in height from end portions on sides of inner surfaces of the pair of support portions, which face each other, toward end portions on sides of end surfaces of the support portions, which are opposite sides to the inner surfaces.

8. The winding inductor component according to claim 6, wherein the terminal electrodes are increased in height from end portions on sides of inner surfaces of the pair of support portions, which face each other, toward end portions on sides of end surfaces of the support portions, which are opposite sides to the inner surfaces.

* * * * *